US009695672B2

(12) United States Patent
Jacob

(10) Patent No.: US 9,695,672 B2
(45) Date of Patent: Jul. 4, 2017

(54) WELLHEAD DOWNHOLE LINE COMMUNICATION ARRANGEMENT

(71) Applicant: Weatherford/Lamb, Inc., Houston, TX (US)

(72) Inventor: Jean-Luc Jacob, Poey de Lescar (FR)

(73) Assignee: Weatherford Technology Holdings, LLC, Houston, TX (US)

( * ) Notice: Subject to any disclaimer, the term of this patent is extended or adjusted under 35 U.S.C. 154(b) by 284 days.

(21) Appl. No.: 14/560,038

(22) Filed: Dec. 4, 2014

(65) Prior Publication Data

US 2015/0083435 A1 Mar. 26, 2015

Related U.S. Application Data

(63) Continuation of application No. 13/142,129, filed as application No. PCT/IB2009/007889 on Dec. 24, 2009, now Pat. No. 8,925,628.

(30) Foreign Application Priority Data

Dec. 24, 2008 (GB) ..... 0823558.2

(51) Int. Cl.

| | |
|---|---|
| ***E21B 34/02*** | (2006.01) |
| ***E21B 33/03*** | (2006.01) |
| ***E21B 33/068*** | (2006.01) |
| ***E21B 33/04*** | (2006.01) |
| ***E21B 33/047*** | (2006.01) |

(52) U.S. Cl.

CPC ..... *E21B 34/02* (2013.01); *E21B 33/04* (2013.01); *E21B 33/047* (2013.01); *E21B 33/068* (2013.01)

(58) Field of Classification Search

CPC ..... E21B 33/03; E21B 33/068; E21B 34/02
USPC ..... 166/85.4, 88.1, 90.1, 91.1, 86.3, 88.4; 251/1.1, 1.3; 285/123.3, 123.16
See application file for complete search history.

(56) References Cited

U.S. PATENT DOCUMENTS

| | | | | |
|---|---|---|---|---|
| 1,839,246 | A * | 1/1932 | Moore | A61C 17/14 285/123.3 |
| 2,122,827 | A * | 7/1938 | Wickersham | E21B 33/04 166/86.2 |
| 4,657,076 | A * | 4/1987 | Tsutsumi | E21B 17/18 166/305.1 |
| 5,465,793 | A * | 11/1995 | Pringle | E21B 17/20 166/319 |
| 5,544,707 | A * | 8/1996 | Hopper | E21B 33/03 166/368 |
| 5,992,527 | A * | 11/1999 | Garnham | E21B 34/04 166/379 |
| 6,186,239 | B1 * | 2/2001 | Monjure | E21B 33/068 166/242.2 |
| 6,357,529 | B1 * | 3/2002 | Kent | E21B 34/04 166/344 |

(Continued)

*Primary Examiner* — Kenneth L Thompson
(74) *Attorney, Agent, or Firm* — Blank Rome, LLP

(57) ABSTRACT

A communication arrangement is disclosed for communication between a downhole line and a wellhead body having a through-hole and a valve member for closing the through-hole. The communication arrangement provides a fluid passage that extends from a wellhead body port to the downhole line thus allowing communication between the wellhead body and a safety valve or valves and/or the injection of chemicals or fluids into the well without the need to rework the valve member or disable the valve member.

18 Claims, 1 Drawing Sheet

(56) References Cited

U.S. PATENT DOCUMENTS

| | | | | |
|---|---|---|---|---|
| 6,675,900 | B2 * | 1/2004 | Baskett | E21B 33/043 166/368 |
| 6,966,383 | B2 * | 11/2005 | Milberger | E21B 33/043 166/368 |
| 7,013,970 | B2 * | 3/2006 | Collie | E21B 29/08 166/344 |
| 7,699,099 | B2 * | 4/2010 | Bolding | E21B 33/03 166/75.11 |
| 8,479,828 | B2 * | 7/2013 | Travis | E21B 33/047 166/379 |
| 8,925,628 | B2 * | 1/2015 | Jacob | E21B 33/03 166/86.3 |
| 2008/0169097 | A1 * | 7/2008 | Bolding | E21B 33/072 166/263 |
| 2008/0202770 | A1 * | 8/2008 | Bolding | E21B 34/02 166/386 |
| 2012/0175103 | A1 * | 7/2012 | Donald | E21B 33/03 166/91.1 |
| 2015/0260010 | A1 * | 9/2015 | Lugtmeier | E21B 34/02 166/379 |

* cited by examiner

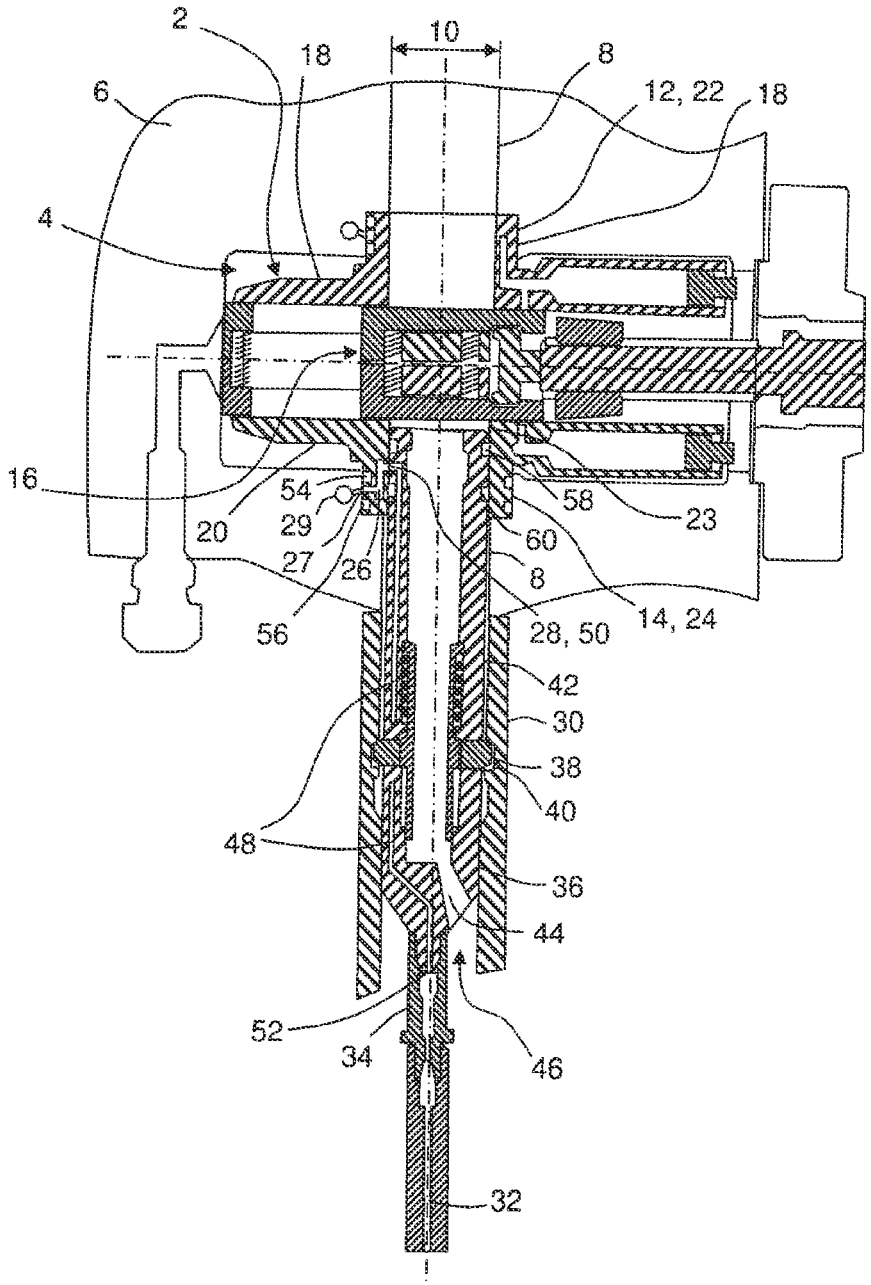
2
10
18
8
6
12, 22
18
4
16
54
29
27
26
20
58
23
60
8
14, 24
56
28, 50
42
30
38
40
48
36
44
52
34
46
32

WELLHEAD DOWNHOLE LINE COMMUNICATION ARRANGEMENT

CROSS REFERENCE

The present application is a Continuation of U.S. application Ser. No. 13/142,129 filed Jun. 24, 2011, which is a National Stage entry from PCT Patent Application No. PCT/IB2009/007889 filed on 24 Dec. 2009, which claims priority to United Kingdom Application 0823558.2 filed on 24 Dec. 2008 the contents of each one incorporated herein by reference.

FIELD OF THE INVENTION

The present invention relates to an apparatus and method for providing communication between a wellhead and a downhole line. Such an invention is suitable for, though not exclusively limited to, use in oil and gas wells.

BACKGROUND OF THE INVENTION

Installing an additional downhole line in a well has historically required major reworking of existing wellhead equipment or disabling of a safety device such as a valve, for example, a lower master valve. Alternatively, installation of such a line has been accomplished by removing the wellhead altogether and using a spool.

SUMMARY OF THE INVENTION

According to a first aspect of the present invention there is provided a communication arrangement for communication between a downhole line and a wellhead body having a through-hole and a valve member for closing the through-hole, the communication arrangement comprising a bridging member and a communication member, wherein the bridging member is configured to engage the valve member and permit movement of the valve member relative thereto, the bridging member is configured for co-operation with the wellhead body so as to provide a first portion of a fluid passage extending from a wellhead body port located in a surface of the wellhead body through-hole, the communication member is configured for attachment to the downhole line, and the communication member is configured to be run into the wellhead body through-hole for co-operation with the bridging member so as to provide a second portion of the fluid passage that is continuous with the first fluid passage portion and extends to the downhole line.

The communication member may be adapted for location below the valve.

The wellhead body port may be located below the valve.

The bridging member may be generally tubular and the first fluid passage portion may be formed in a wall of the bridging member.

The communication member may be generally tubular and the second fluid passage portion may be formed in a wall of the communication member.

The first fluid passage portion may have an inlet port which is aligned adjacent to the wellhead body port when the bridging member co-operates with the wellhead body.

The first fluid passage portion may have an outlet port, the second fluid passage portion may have an inlet port and the outlet port of the first fluid passage portion may be aligned adjacent to the inlet port of the second fluid passage portion when the communication member is run into the wellhead body through-hole.

The second fluid passage portion may have an outlet port which is connected to an upper end of the downhole line.

The bridging member may sealingly engage the wellhead body.

The bridging member may sealingly engage the communication member.

The wellhead body port may be a grease port.

The communication member may be adapted to engage a hanger device attached to the wellhead body.

The hanger device may be suspended from the wellhead body.

The communication member may comprise one or more elements for engaging a corresponding profile formed in the hanger device.

The bridging member may comprise a valve seat.

The valve member may comprise a gate valve member.

The valve seat may be configured to permit sliding of the gate valve member relative thereto.

According to a second aspect of the present invention there is provided a method of communicating between a downhole line and a wellhead body having a through-hole and a valve member for closing the through-hole, the method comprising the steps of:

co-operating a bridging member with the wellhead body so as to engage the bridging member with the valve member and permit movement of the valve member relative thereto and so as to provide a first portion of a fluid passage that extends from a wellhead body port located in a surface of the wellhead body through-hole;

attaching a communication member to the downhole line;

running the communication member into the wellhead body through-hole so as to co-operate with the bridging member so as to provide a second portion of the fluid passage which is continuous with the first fluid passage portion and extends to the downhole line; and passing fluid through the fluid passage.

The method may comprise replacing an existing valve seat with the bridging Member.

According to a third aspect of the present invention there is provided a communication arrangement for communication between a wellhead body and a downhole line, the communication arrangement comprising a communication member adapted to be run into a through-hole of the wellhead body on as to provide at least a portion of a fluid passage that extends between the downhole line and a wellhead body port located in a surface of the wellhead body through-hole.

The wellhead body may accommodate a valve for closing the wellhead body through-hole. The communication member may be adapted for location below the valve. In one embodiment the valve may be a lower master valve.

Such a communication arrangement may be installed without the need for major rework to the valve. Furthermore, the communication arrangement facilitates the introduction of one or more downhole lines without disabling the valve. Such a downhole line or lines may be a control line or lines for the control of a downhole safety valve or valves, or may be suitable for the injection of surfactants or the introduction of other chemicals or fluids into the well.

The wellhead body port may be provided in a cylindrical surface portion of the wellhead body through-hole. The wellhead body port may be located below the valve.

The communication arrangement may further comprise a bridging member adapted for co-operation with both the wellhead body and the communication member, the bridging member defining a first portion of the fluid passage and the communication member defining a second portion of the fluid passage.

The first fluid passage portion may be formed in the bridging member. The bridging member may, for example, be generally tubular and the first fluid passage portion may be formed in a wall of the bridging member. The bridging member may be adapted to be positioned relative to the wellhead body such that an inlet port of the first fluid passage portion is aligned adjacent to the wellhead body port.

The second fluid passage portion may be formed in the communication member. The communication member may, for example, be generally tubular and the second fluid passage portion may be formed in a wall of the communication member. The communication member may be adapted to be positioned relative to the bridging member such that an inlet port of the second fluid passage portion is aligned adjacent to an outlet port of the first fluid passage portion. An outlet port of the second fluid passage portion may be connected to an upper end of the downhole line.

The wellhead body through-hole may generally have a principal cross-section. The wellhead body through-hole may, for example, generally have a principal diameter. The wellhead body through-hole may extend through a cavity formed in the wellhead body. Adjacent to an opening of the wellhead body through-hole into the cavity, the wellhead body through-hole may comprise a portion having an enlarged cross-section relative to the principal cross-section of the wellhead body through-hole so as to form a recess or profile in the wellhead body in the vicinity of the opening of the wellhead body through-hole. For example, the wellhead body through-hole may comprise a portion having an enlarged diameter relative to the principal diameter of the wellhead body through-hole so as to form a cylindrical recess or profile in the wellhead body in the vicinity of the opening of the wellhead body through-hole. The bridging member may be fitted at least partially into the recess or profile in the wellhead body. For example, the bridging member may be pressed or otherwise located at least partially into the recess or profile in the wellhead body. The bridging member may be splined or profiled to ensure alignment with the wellhead body. The bridging member may be in threaded engagement with the wellhead body. For example, the bridging member may comprise an externally threaded portion in threaded engagement with an internally threaded portion of the wellhead body.

The bridging member may be a valve seat, for example, a lower valve seat.

The bridging member may have a through-hole that may be adapted to be co-axial with the wellhead body through-hole. The bridging member through-hole may have a smaller cross-section than a cross-section of the wellhead body through-hole. For example, the bridging member through-hole may have a smaller diameter than a diameter of the wellhead body through-hole. The through-hole of the communication member may be co-axial with the through-hole of the bridging member. An outer surface of the communication member may be adapted for co-operation with the through-hole of the bridging member.

At least one seal may be disposed between a surface of the wellhead body through-hole and a surface of the bridging member. The wellhead body through-hole may, for example, include at least one seal for co-operation with the bridging member and/or the bridging member may include at least one seal for co-operation with the wellhead body through-hole.

One of the wellhead body through-hole or bridging member surfaces may, for example, be presented with one or more seals and, optionally, the opposed surface may be honed to co-operate with the one or more seals.

The at least one seal may provide a seal around the wellhead body port. A first seal may, for example, be located above and a second seal located below the wellhead body port.

At least one seal may be disposed between a surface of the bridging member and a surface of the communication member. The bridging member may, for example, include at least one seal for co-operation with the communication member and/or the communication member may include at least one seal for co-operation with the bridging member.

One of the bridging member or communication member surfaces may, for example, be presented with one or more seals and, optionally, the opposed surface may be honed to co-operate with the one or more seals.

The at least one seal between the bridging member and the communication member may provide a seal around the outlet from the first fluid passage portion provided by the bridging member and the inlet to the second fluid passage portion provided by the communication member. A first seal may, for example, be located above and a second seal located below the outlet from the first fluid passage portion and the inlet to the second fluid passage portion.

The wellhead body port may be any type of port that provides access to the wellhead body through-hole. The wellhead body port may, for example, be intentionally manufactured for use with a downhole line. The wellhead body port may be manufactured before assembly of the wellhead body or may be manufactured by a method such as drilling after assembly of the wellhead body once in position at a wellhead.

The wellhead body port may, alternatively, be an existing port that provides access to the wellhead body through-hole such as a spare port or a grease port or the like. When the wellhead body port is an existing port, the communication arrangement allows the introduction of one or more downhole lines without having to change the wellhead body.

The communication member may be adapted to engage a hanger device which hanger device may be attached to the wellhead body. The hanger device may, for example, be suspended from the wellhead body.

The hanger device may be generally tubular and have a through-hole which is generally co-axial with the wellhead body through-hole. The communication member may be adapted to be run into the hanger device through-hole and engage an internal surface or profile thereof so as to lock the communication member in position relative to the hanger device. The communication member may, for example, comprise one or more engaging elements that engage a corresponding profile, groove or grooves formed in the hanger device.

According to a fourth aspect of the present invention there is provided a communication member having a through-hole wherein the communication member is adapted to be run into a through-hole of a wellhead body so as to provide at least a portion of a fluid passage that extends from the wellhead body to a downhole line and which fluid passage is separate from the communication member through-hole.

The communication member may, for example, be generally tubular and the communication member fluid passage may be formed in a wall of the communication member.

The communication member fluid passage may, for example, extend from a first port on an external surface of the communication member to a second port on the external surface of the communication member. The first port may be formed on a cylindrical portion of the external surface of the communication member. The second port may be formed at one end of the communication member.

According to a fifth aspect of the present invention there is provided a bridging member having a through-hole wherein the bridging member is adapted to co-operate with a through-hole of a wellhead body so as to provide at least a portion of a fluid passage that extends from the wellhead body to a downhole line and which fluid passage is separate from the bridging member through-hole.

The bridging member may, for example, be generally tubular and the bridging member fluid passage may be formed in a wall of the bridging member.

The bridging member fluid passage may, for example, extend from a first port on an external surface of the bridging member to a second port on an internal surface of the bridging member.

According to a sixth aspect of the present invention there is provided a method of communicating between a wellhead body and a downhole line, the method comprising the steps of running a communication member into a through-hole of the wellhead body so as to provide at least a portion of a fluid passage between the downhole line and a wellhead body port in a surface of the wellhead body through-hole, and passing fluid through the fluid passage.

BRIEF DESCRIPTION OF THE DRAWINGS

The present invention will be further described by way of non-limiting example only with reference to the following FIGURE of which:

The FIGURE shows an apparatus constituting an embodiment of the invention located in the vicinity of a wellhead.

DETAILED DESCRIPTION OF THE DRAWINGS

The FIGURE shows an embodiment of a communication arrangement comprising a lower master valve assembly generally designated 2 located in a lower master valve cavity 4 within a wellhead body 6. The wellhead body 6 comprises a through-bore 8 that extends through the lower master valve cavity 4 and generally has a principal diameter 10. Adjacent to and above the lower master valve cavity 4 the through-bore 8 comprises a co-axial upper portion 12 having an enlarged internal diameter relative to the principal diameter 10 of the through-bore 8. Similarly, adjacent to and below the lower master valve cavity 4, the through-bore 8 comprises a co-axial lower portion 14 having an enlarged internal diameter relative to the principal diameter 10 of the through-bore 8.

The lower master valve assembly 2 further comprises a gate assembly 16, an upper valve seat 18 and a lower valve seat 20. In the FIGURE, the gate assembly 16 is shown in a closed position in which the gate assembly 16 occludes the through-bore 8 at a position within the lower master valve cavity 4.

The upper valve seat 18 comprises an upper valve seat through-bore 20 having a diameter matched to the principal diameter 10 of the through-bore 8. The upper valve seat 18 further comprises an outer portion 22 having an external diameter that engages the internal diameter of the upper portion 12 of the through-bore 8 so that the through-bore 8 and the upper valve seat through-bore 20 are co-axial. In the embodiment shown in the FIGURE, the portion 22 of the upper valve seat 18 is press fitted into the upper portion 12 of the through-bore 8.

Similarly, the lower valve seat 20 comprises a lower valve seat through-bore 23 having a diameter less than the principal diameter 10 of the through-bore 8. The lower valve seat 20 further comprises an outer portion 24 having an external diameter that engages the internal diameter of the lower portion 14 of the through-bore 8 so that the through-bore 8 and the lower valve seat through-bore 23 are co-axial. In the embodiment shown in the FIGURE, the portion 24 of the lower valve seat 20 is press fitted into the lower portion 14 of the through-bore 8.

The lower valve seat 20 further comprises a fluid passage 26 formed through a wall thereof, the fluid passage 26 extending from a lower valve seat inlet port 27 on an external surface of the lower valve seat 20 to a lower valve seat outlet port 28 on an internal surface of the lower valve seat 20. As shown in the FIGURE, when the portion 24 of the lower valve seat 20 engages the lower portion 14 of the through-bore 8, the lower seat inlet port 27 is aligned adjacent to a lower grease port 29 located in a cylindrical surface of the through-bore 10 at a position below the gate assembly 16.

Suspended below the wellhead body 6 is a tubular nipple hanger 30, the nipple hanger 30 being co-axial with the through-bore 8.

To provide a line 32 for fluid communication downhole, the gate assembly 16 is opened and the line 32 is run into the through-bore 8. An upper end of the line 32 is connected to a lower nozzle portion 34 of a control line hanger plug 36 and the control line hanger plug 36 is run into the through-bore 8 until at least one spring-loaded dog 38 of the control line hanger plug 36 engages a groove 40 in an internal surface of the nipple hanger 30 as shown in the FIGURE. The control line hanger plug 36 has a generally tubular upper portion 42 such that when the control line hanger plug 36 is located in the position shown in the FIGURE, the upper portion 42 of the control line hanger plug 36 opens at an upper end thereof onto, and is co-axial with, the through-bore 23 of the lower valve seat 20. A primary fluid passage 44 extends from a lower end of the generally tubular upper portion 42 of the control line hanger plug 36. In use, the primary fluid passage 44 provides fluid communication with a well bore 46 when the well is flowing. The control line hanger plug 36 further comprises a fluid passage 48 that extends from an inlet port 50 on an external surface of the upper portion 42 down through a wall of the control line hanger plug 36 to an outlet port 52 located at an end of the lower nozzle portion 34 of the control line hanger plug 36.

With the control line hanger plug 36 located in the position shown in the FIGURE, the inlet port 50 of the control line hanger plug 36 is aligned adjacent to the outlet port 28 of the lower valve seat 20 so as to provide a continuous fluid passage between the lower grease port 29 through the fluid passage 26 of the lower valve seat 20 and the fluid passage 48 of the control line hanger plug 36 to the downhole line 32. The lower grease port 29 therefore provides an access point for fluid communication through the continuous fluid passage between the wellhead body 6 and the downhole line 32.

The lower portion 14 of the through-bore 8 is provided on the internal surface thereof with first and second annular seals 54,56 above and below the lower grease port 29 so as to sealingly engage an external surface of the portion 24 of the lower valve seat 20. Such seals 54,56 also serve to isolate the area around the lower grease port 29 and the inlet port 27 of the lower valve seat 20.

Similarly, the tubular upper portion 42 of the control line hanger plug 36 is also provided on an external surface thereof with first and second annular seals 58,60 above and below the inlet port 50 of the control line hanger plug 36 so as to sealingly engage an internal surface of the lower valve seat through-bore 23. Such seals also serve to isolate the area around the outlet port 28 of the lower valve seat 20 and the inlet port 50 of the control line hanger plug 36.

It should be understood that the embodiments described herein are merely exemplary and that various modifications may be made without departing from the scope of the present invention.

The invention claimed is:

1. A communication arrangement for communication between a downhole line and a wellhead body, the wellhead body having a wellhead body through-hole, a gate valve member for selectively closing the wellhead body through-hole, and a wellhead body port, and the communication arrangement comprising:

a lower valve seat configured to engage the gate valve member so as to permit movement of the gate valve member relative thereto, the lower valve seat defining a lower valve seat through-hole and a lower valve seat fluid passage, the lower valve seat fluid passage being distinct from the lower valve seat through-hole; and a communication member defining a communication member through-hole and a communication member fluid passage, wherein the communication member is attached to the downhole line, the lower valve seat is configured to co-operate with the wellhead body, and the communication member is configured to be run into the wellhead body through-hole and into the lower valve seat through-hole until the communication member fluid passage is aligned in fluid flow communication with the lower valve seat fluid passage so as to define a continuous fluid passage which extends from the wellhead body port to the downhole line.

2. The communication arrangement as claimed in claim 1 in which the communication member is adapted for location below the gate valve member.

3. The communication arrangement as claimed in claim 1 in which the wellhead body port is located below the gate valve member.

4. The communication arrangement as claimed in claim 1 in which the lower valve seat is generally tubular and the lower valve seat fluid passage is formed in a wall of the lower valve seat.

5. The communication arrangement as claimed in claim 1 in which the communication member is generally tubular and the communication member fluid passage is formed in a wall of the communication member.

6. The communication arrangement as claimed in claim 1 in which the lower valve seat fluid passage has an inlet port which is aligned adjacent to the wellhead body port when the lower valve seat co-operates with the wellhead body.

7. The communication arrangement as claimed in claim 1 in which the lower valve seat fluid passage has an outlet port, the communication member fluid passage has an inlet port, and the outlet port of the lower valve seat fluid passage is aligned adjacent to the inlet port of the communication member fluid passage when the communication member is run into the wellhead body through-hole.

8. The communication arrangement as claimed in claim 1 in which the communication member fluid passage has an outlet port which is connected to an upper end of the downhole line.

9. The communication arrangement as claimed in claim 1 in which the lower valve seat sealingly engages the wellhead body.

10. The communication arrangement as claimed in claim 1 in which the lower valve seat sealingly engages the communication member.

11. The communication arrangement as claimed in claim 1 in which the wellhead body port is a grease port.

12. The communication arrangement as claimed in claim 1 in which the communication member is adapted to engage a hanger device attached to the wellhead body.

13. The communication arrangement as claimed in claim 12 in which the hanger device is suspended from the wellhead body.

14. The communication arrangement as claimed in claim 12 in which the communication member comprises one or more elements for engaging a corresponding profile formed in the hanger device.

15. A method of communicating between a downhole line and a wellhead body, the wellhead body having a through-hole, a gate valve member for selectively closing the wellhead body through-hole, and a wellhead body port, the method comprising the steps of:

engaging a lower valve seat with the wellhead body so as to permit movement of the gate valve member relative to the lower valve seat, the lower valve seat defining a lower valve seat through-hole;

attaching a downhole line to a communication member; and running the communication member into the wellhead body through-hole and into the lower valve seat through-hole until a communication member fluid passage defined by the communication member is aligned in fluid flow communication with a lower valve seat fluid passage defined by the lower valve seat so as to define a continuous fluid passage which extends from the wellhead body port to the downhole line, wherein the lower valve seat through-hole and the lower valve seat fluid passage are distinct.

16. The method as claimed in claim 15 comprising replacing an existing valve seat with the lower valve seat.

17. A communication arrangement for communication between a downhole line and a wellhead body, the wellhead body having a wellhead body through-hole, a gate valve member for selectively closing the wellhead body through-hole, and a wellhead body port, and the communication arrangement comprising:

a lower valve seat configured to engage the gate valve member so as to permit movement of the gate valve member relative thereto, the lower valve seat defining a lower valve seat through-hole and a lower valve seat fluid passage; and a communication member defining a communication member through-hole and a communication member fluid passage, wherein the communication member is attached to the downhole line, the lower valve seat is configured to co-operate with the wellhead body, and the communication member is configured to be run into the wellhead body through-hole and into the lower valve seat through-hole until the communication member fluid passage is aligned in fluid flow communication with the lower valve seat fluid passage so as to define a continuous fluid passage which extends from the wellhead body port to a fluid passage defined inside the downhole line.

18. A method of communicating between a downhole line and a wellhead body, the wellhead body having a through-hole, a gate valve member for selectively closing the wellhead body through-hole, and a wellhead body port, the method comprising the steps of:

engaging a lower valve seat with the wellhead body so as to permit movement of the gate valve member relative to the lower valve seat, the lower valve seat defining a lower valve seat through-hole;

attaching a downhole line to a communication member; and running the communication member into the wellhead body through-hole and into the lower valve seat through-hole until a communication member fluid passage defined by the communication member is aligned in fluid flow communication with a lower valve seat fluid passage defined by the lower valve seat so as to define a continuous fluid passage which extends from the wellhead body port to a fluid passage defined inside the downhole line.

* * * * *